United States Patent [19]

Lindsey et al.

[11] Patent Number: 4,868,356

[45] Date of Patent: Sep. 19, 1989

[54] EASILY SERVICED FLUID PRESSURE OPERATED SWITCH

[75] Inventors: Kurt Lindsey, Batavia; Clem P. Sitar, Addison, both of Ill.

[73] Assignee: Furnas Electric Company, Batavia, Ill.

[21] Appl. No.: 246,911

[22] Filed: Sep. 22, 1988

[51] Int. Cl.[4] ..... H01H 35/34

[52] U.S. Cl. ..... 200/83 P; 73/723; 200/81.4; 200/83 S

[58] Field of Search ..... 200/81 R, 81.4, 81.5, 200/302.1, 308, 83 R, 83 J, 83 S, 83 SA, 83 P; 340/626; 91/1; 92/5 R; 307/118; 73/717, 723

[56] References Cited

U.S. PATENT DOCUMENTS

| | | | |
|---|---|---|---|
| 4,243,858 | 1/1981 | Place | 200/83 P |
| 4,343,974 | 8/1982 | Hire | 200/83 R |
| 4,626,636 | 12/1986 | Hickman | 200/83 S |
| 4,644,116 | 2/1987 | Miyakawa | 200/83 R |

*Primary Examiner*—Gerald P. Tolin

*Attorney, Agent, or Firm*—Wood, Dalton, Phillips, Mason & Rowe

[57] ABSTRACT

Disconnection of a fluid conduit from a fluid fitting 38 and electrical conduit from apertures 28 in a fluid pressure sensing switch when servicing is required is avoided in a construction wherein a switch module 12 is secured to a base 10 mounting a fluid pressure receiving fitting 38 and electrical conduit receiving apertures 28 by only two threaded fasteners 24, allowing the module 12 to be separated readily from the base 10 without disturbing conduit connections.

12 Claims, 2 Drawing Sheets

112
114
5
5
98
132
110
108
118
106
122
116
120
84
186
90
184
150
148
128
126
174
178
172
138
182
136
124
86
130
92
134
190
26

100
98
102
100
98
100
LINE
LOAD
LOAD
LINE
104
104

202
94
94
26
26
200
192
198
194
196

174
180
178
172
152
146
142
146
124
140
126
86
144

170
174
172
180
180
168
160
154
160
162
176
170
172
158
162
156
146
124
166
166
126
120
86

EASILY SERVICED FLUID PRESSURE OPERATED SWITCH

FIELD OF THE INVENTION

This invention relates to a fluid pressure operated switch, and more specifically, to such a switch having electrical components that may be readily replaced without disconnecting the switch in its entirety from the electrical and fluid systems in which it is installed.

BACKGROUND OF THE INVENTION

Fluid pressure operated switches are used in a variety of applications. Some of the most common applications include control of water pumping and pressurization systems and air compressors.

In the former, as typified by many home water systems supplied by well water, a submersible pump is operative to elevate water to a sealed reservoir or tank. Because the tank is sealed, as it fills, the pressure of air above the water in the tank increases. This pressure head is used to drive water from the tank into the distribution system within the home when faucets or valves are opened. Check valves are utilized to prevent such pressure from driving the water back into the well.

Quite typically, the pressure within the reservoir is taken as a measure of the degree of filling thereof. Most usually, pressure is monitored at a tank outlet which will be below the level of water in the reservoir by means of a water pressure sensing switch which in turn is operative to initiate operation of the pump when pressure is low and to halt operation of the pump when pressure is raised to a level indicating that the reservoir has been sufficiently filled.

In air compressor systems, switch operation is generally similar save for the fact the switches are not coupled to liquid under pressure, but rather, to air under pressure.

In either case, these switch systems include some sort of mechanical coupling by means of a conduit to the source of fluid under pressure that is to be monitored. In addition, the electrical side of the switches will frequently be rigidly connected to an electrical conduit containing the electrical conductors forming part of the circuit which is being controlled by the switch. Pressure sensing in such switches is normally accomplished by diaphragms of one sort or another and experience has illustrated that, when properly designed, the diaphragms in switches of this type are relatively failure free and do not readily wear out.

In contrast, as is well known, the making and breaking of electrical circuits by contacts exposed to air causes progressive deterioration of the contacts to the point where ultimately they cannot establish or break the electrical circuit in which they are contained.

When this occurs with fluid a pressure operated switch, it has been the rule to remove the switch from the system and discard the same, installing a whole new switch in lieu thereof. This, of course, requires that the fluid containing conduit be disconnected from the switch as well as the freeing of the switch from electrical conduits. Where liquid pressure is being monitored, disconnection of the fluid conduit from the switch will result in spillage of the liquid which must be cleaned up and in all events, considerable manual effort may be expended in disconnecting the fluid conduit from the switch as well as disconnecting electrical conduits from the switch.

The present invention is directed to overcoming the above problems.

SUMMARY OF THE INVENTION

It is the principal object of the invention to provide a new and improved fluid pressure operated switch. More specifically, it is an object of the invention to provide such a switch which may be easily serviced without disconnecting it from a source of pressure fluid being monitored or from electrical conduits housing electrical conductors that extend to the switch.

An exemplary embodiment of the invention achieves the foregoing objects in a switch construction including a base provided with an actuating aperture and at least one electrical conduit mounting aperture. A diaphragm is mounted on the base over the actuating aperture and a diaphragm housing is secured and sealed against the base to contain the diaphragm. The diaphragm housing has a fluid conduit receiving fitting on the side of the diaphragm remote from the base.

A switch contact module includes readily disconnectable electrical terminals which are adapted to be connected into the electrical circuit to be controlled as well as relatively movable switch contacts for opening or closing such an electrical circuit. Removable fastening means extend between the module and the base for removably securing the module in a desired position on the base and motion transmitting means are carried by at least one of the base and the module and include an actuator extending through the actuating aperture into nonconnected but abutting contact with the diaphragm, and an operator movable in response to movement of the actuator for opening and closing the relatively movable contacts in the switch module.

As a result of this construction, when the switch is installed with the fluid conduit receiving fitting connected to a fluid conduit and with an electrical conduit housing electrical conductors extending to the terminals being secured to the electrical conduit mounting aperture, replacement of the module and the contacts therein may be readily effected by disconnecting the conductors from the terminals and removing the fasteners and without disconnecting the fluid and electrical conduits from the base.

According to one aspect of the invention, the base is generally U-shaped and the actuating aperture is in the bight of the U-shaped base with the electrical conduit mounting apertures in the legs of the U-shaped base.

The invention also contemplates that nonsecuring mating means on the legs of the base and on the module are to be provided for orienting the module in the desired position relative to the base prior to the application or the removal of fastening means.

In a preferred embodiment of the invention, the motion transmitting means comprises a lever pivoted to the base.

In a highly preferred embodiment, the motion transmitting means comprises the lever pivoted to the module.

In the exemplary embodiment, the motion transmitting means comprises nonconnected but interengaging levers, one pivoted on the base and another pivoted on the module.

The invention contemplates that the mating means comprise open ended slots in one of the module and the legs and projections slideably received in the slots and carried by the other of the module and the legs.

In a highly preferred embodiment, the slots are disposed in the legs and the projections are carried by the module.

According to another aspect of the invention, the motion transmitting means includes a first lever pivotally mounted on the base and having the aforementioned actuator, and the module includes a second lever in abutting but non-contacting relation to the first lever. A third lever is pivoted to the second lever and carries at least one movable contact. The module further includes a module base pivotably mounting the second and third levers and carrying fixed contacts as well as the terminals.

According to one aspect of the invention, resilient compressible means interconnect the second and third levers and are disposed to be under maximum compression when the second and third levers are between two extreme positions of relative movement with respect to one another to thereby provide an over-center, snap action connection between the second and third levers.

According to another aspect of the invention, a first spring interconnects the second lever and the module base for urging the second lever toward the first lever and a second spring interconnects the third lever and the module base for urging the third lever toward the fixed contacts.

In a highly preferred embodiment of the invention, the movable contact is loosely impaled on a post carried by the third lever and the second spring further acts against the movable contact oppositely of the third lever to maintain the movable contact on the post.

The invention further contemplates that the module base reciprocally mount a plunger in alignment and engageable with the first lever. Spring means are carried by the module base for biasing the plunger toward the first lever and means are carried by the module for adjusting the bias of the spring means. Further provided is an adjustable biasing means carried by the base for biasing the first lever toward the diaphragm.

Other objects and advantages will become apparent from the following specification taken in connection with the accompanying drawings.

DESCRIPTION OF THE PREFERRED EMBODIMENT

Figure 1:
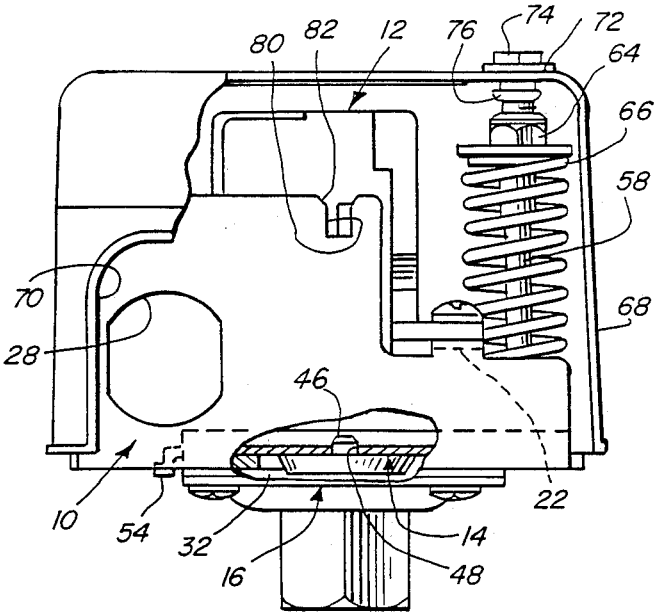
FIG. 1 is a side elevation of a fluid pressure operated switch made according to the invention with parts broken away and other parts shown in section for clarity.
Figure 3:
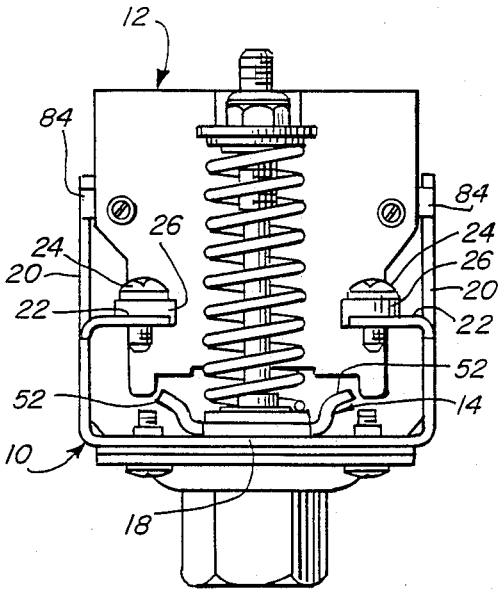
FIG. 3 is a view of the switch with the cover removed and taken from the right of FIG. 1.
Figure 2:
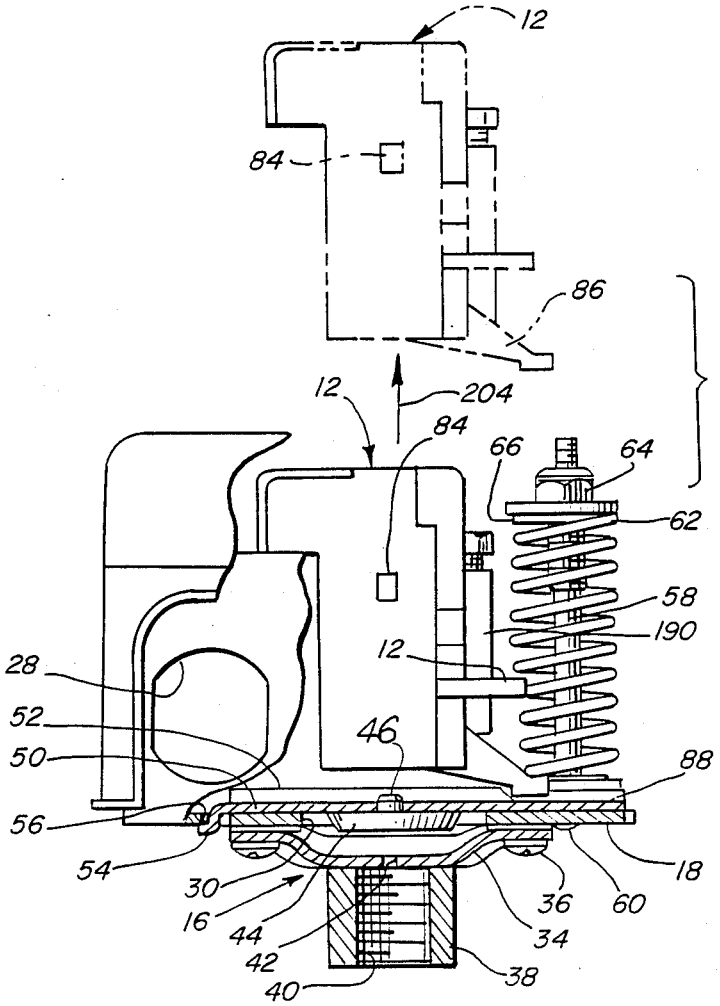
FIG. 2 is a view similar to FIG. 1 but with additional components broken away and/or shown in section and illustrating how a switch contact containing module may be readily removed from the switch assemblage.

An exemplary embodiment of a fluid pressure operated switch made according to the invention is illustrated in the drawings and with reference to FIGS. 1–3, is seen to include a base, generally designated 10, mounting a removable switch module, generally designated 12. A motion transmitting system, generally designated 14, links a fluid pressure sensing diaphragm assembly, generally designated 16, secured to the base 10 to the switch module 12. Referring to FIG. 3 specifically, the base 10 is seen to include a bight 18 flanked by upstanding legs 20. Mid way from top to bottom, each of the legs 20 has inwardly turned, horizontal tabs 22. The tabs 22 are adapted to receive threaded fasteners 24, specifically two such fasteners 24, which extend through horizontally directed ears 26 on the switch module 12 to secure the latter to the base 10. The two threaded fasteners 24 are the sole means by which the module 12 is secured to the base 10 so that, as will appear more fully hereinafter, upon removal of the threaded fasteners 24, the module 12 may be easily removed from the base 10.

Each of the legs 20 also include an aperture 28 which may, but generally will not be, provided with a knock out. As is well known, the apertures 28 are adapted to receive the conventional connection on the end of a piece of electrical conduit so that electrical conductors contained within such conduit may enter the switch through the apertures 28 between the legs 20.

As can be seen in FIGS. 1 and 2, the bight 18 includes a generally central actuating aperture 30. A conventional diaphragm 32 covers the aperture 30 on the side of the bight 18 remote from the legs 20 and a shallow, cup-like diaphragm housing 34 is secured as by threaded fasteners 36 to the bight 18 in sandwiching relation against the diaphragm 32 to secure and seal the same over the aperture 30. The diaphragm housing 34 has a fluid conduit receiving fitting 38 brazed or soldered thereto. As can best be seen in FIG. 2, the fitting 38 includes an internal, threaded bore 40 which, by means of a small port 42 in the housing 34 is in fluid communication with the side of the diaphragm 32 remote from the aperture 30. Thus, a conduit containing fluid whose pressure is to be monitored by the switch may be threaded into the bore 40 so that the pressure of the fluid contained therein will be applied to the diaphragm 32.

The motion transmitting mechanism 14 includes an actuator 44 in the form of a button located within the aperture 30 in the bight 18 and in abutment with the side of the diaphragm 32 opposite the fitting 38. The actuator 44 includes a pin 46 received in an aperture 48 in an elongated lever 50 as can be seen in FIGS. 1 and 2. However, in lieu of the actuator 44 as a separate button, the same could be in the form of a protuberance or the like stamped in the lever 50 and of sufficient depth as to extend through the aperture 30 into engagement with the diaphragm 32.

The lever 50 is in the form of a shallow channel, having spaced apart sides 52. It terminates at one end in a zigzag formation 54 that extends through a small slot 56 in the bight 18 to thereby pivotally mount the lever 50 to the base 10.

Opposite of the zigzag formation 54, a threaded post 58 is staked as at 60 to the bight 18. The post 58 extends through an aperture (not shown) in the lever 50 and a compression coil spring 62 surrounds the post 58 and its lower end is in engagement with the lever 50. A nut and washer assembly 64 abuts the upper end 66 of the spring 62. By selective adjustment of the position of the nut 64 on the post 58, the degree of compression of the spring 62 may be selectively adjusted and that in turn will adjust the biasing force applied to the lever 50 and ultimately to the diaphragm 32 oppositely of the source of fluid under pressure.

A box-like cover 68 may be provided and will typically includes side slots 70 in alignment with the apertures 28 so as to allow access thereto. At its upper surface, the cover 68 may be provided with a lock 72 having an operating end 74 on the external side of the cover and a nut-like element 76 on the interior and in alignment with the post 58. By turning the operating end 74, the nut-like structure 78 may be threaded on the upper end of the post 58 to secure the cover 68 to the switch. Access to the interior of the switch may be had by reversing the aforementioned action.

To aid in properly locating the module 12 within the switch assembly, each of the legs 20, at its upper edge, is provided with an upwardly opening slot 80 (FIG. 1). The slots 80 include pilots 82 at their point of emergence from the legs 20. At opposite sides of the module 12 are horizontally directed projections 84 which are slideably received in corresponding ones of the slots to provide a non secured, but mating connection whereby the module 12 may be retained in the proper location by means of the threaded fasteners 24 as mentioned previously. The arrangement is such that, as best seen in FIG. 2, the module 12 will be disposed between the legs 20 such that a second lever 86 carried by the module 12 will be in non connected, but contacting relation with the upper surface 88 of the lever 50. Thus, movement of the lever 50 against the bias of the spring 62 will be conveyed to the module 12 by movement of the lever 86 associated therewith. The exact manner of such association will be described in greater detail hereinafter.

Figure 4:
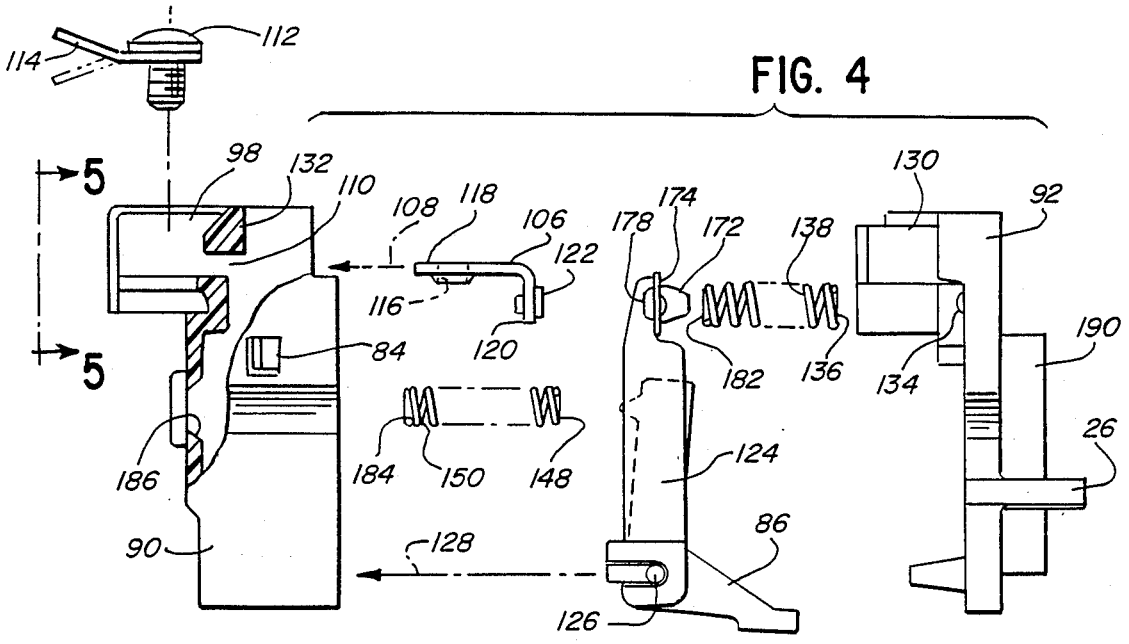
FIG. 4 is an exploded view of a switch module.
Figure 5:
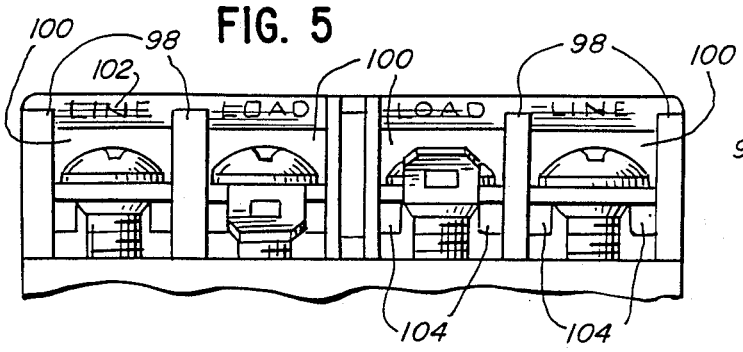
FIG. 5 is a fragmentary view taken approximately along the line 5—5 in FIG. 4.
Figure 6:
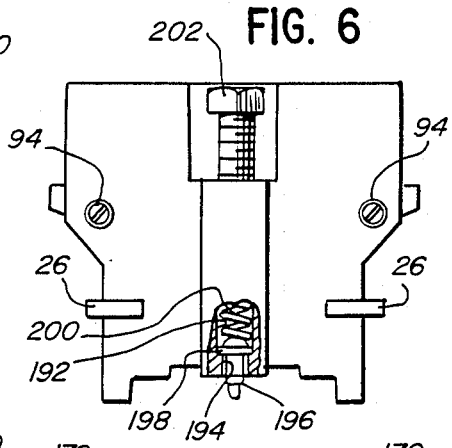
FIG. 6 is a side elevation of the switch module taken from the right of FIG. 4 with certain components omitted for clarity.

Turning now to FIGS. 4–6 inclusive, the construction of the module 12 will be described in greater detail. Each module 12 includes a module base 90 molded of plastic or the like and a cover 92 for such base 90. The two may secured in assembled relation by threaded fasteners 94 (FIG. 6). As seen in FIGS. 4 and 5, the upper left hand end of the module base 90 includes vertically oriented partitions 98 which define terminal compartments 100. If desired, the compartments 100 may be provided with indicia 102 indicating how the associated terminal is to be connected to an electrical circuit.

Near the lower extremity of each partition 98, horizontal contact mounting tongues 104 extend toward each other partially across each compartment 100. L-shaped contact assemblies 106 (FIG. 4) may be inserted in the direction of an arrow 108 through openings 110 into each of the compartments 100 to be supported on the upper surfaces of the tongues 104 to receive terminal screws 112 which may or may not be provided with spade terminals 114. That is to say, the terminal screws 112 are received in apertures 116 in a horizontally oriented part 118 of each contact assembly 106 as viewed in FIG. 4, and define readily releasable connection points. A vertically oriented section 120 of each contact assembly 106 mounts an actual contact 122.

A third lever 124 is pivoted as by an elongated pin 126 to the second lever 86 to form a lever assembly. The lever assembly is inserted in the direction of an arrow 128 into a cavity within the module base 90 which also receives the pivot pin 126 whereby the levers 86 and 124 are not only pivoted to each other, but pivoted to the module base 90 as well. A further description of the second and third levers 86 and 124 will follow in connection with the description of FIGS. 7 and 8.

Addressing now the cap 92, the same includes the horizontally directed ears 26 which, it will be recalled, are the means by which the module 12 is secured in place within the base 10. Also included is a horizontally directed partition 130 which may abut a cross member 132 on the base 90 to support the same. On opposite sides of the partition 130, spring receiving nubs 134 for loose receipt of ends 136 of compression coil springs 138 are provided.

Figure 7:
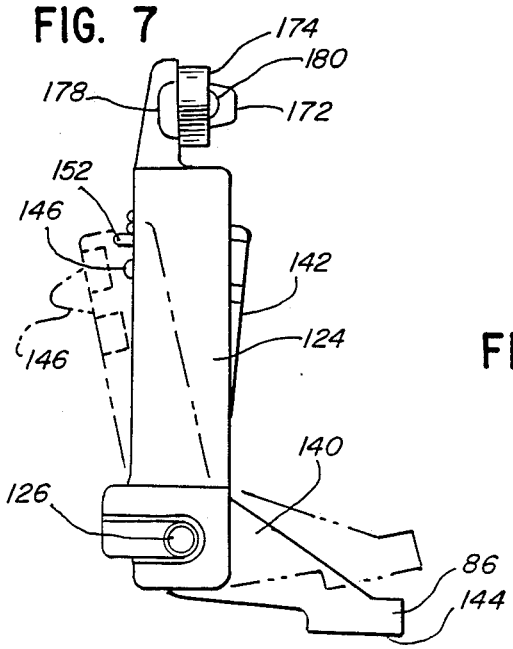
FIG. 7 is a side elevation of a lever system utilized in the switch module.
Figure 8:
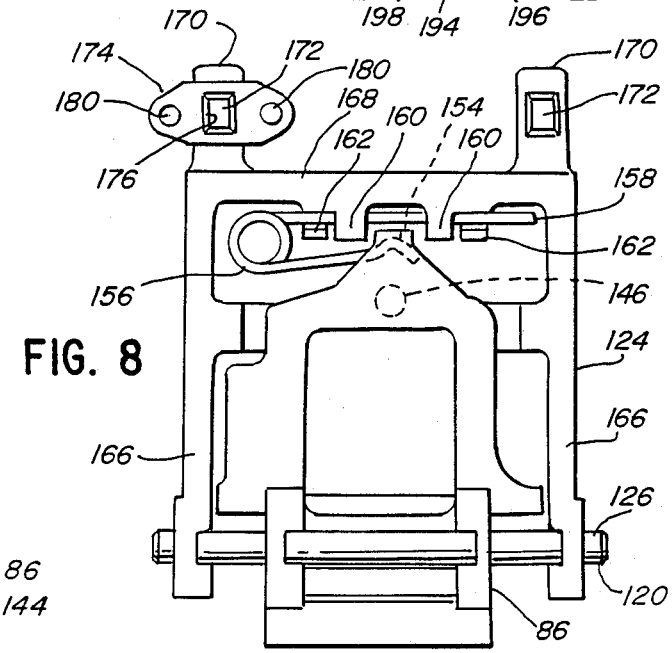
FIG. 8 is an elevation of the lever module taken from the right of FIG. 7.

Turning now to FIGS. 7 and 8, it will be seen that the second lever 86 is in fact a bell crank have a first arm 140 and a second arm 142. The arm 140 has an abutment surface 144 adapted to abut the upper surface 88 of the first lever 50 (FIG. 2) when the module 12 is assembled to the base 10. The arm 142 includes a spring end receiving nub that projects generally horizontal oppositely the arm 140 to receive an end 148 of a compression coil spring 150 (FIG. 4).

At its uppermost end, the arm 142 includes an upwardly opening slot 152 (FIG. 7) which receives one end 154 of a wound spring 156 as seen in FIG. 8. The other end 158 of the spring 156 is received between projections 160 and 162 on the lever 124. More specifically, the lever 124 has an inverted U-shape configuration with legs 166 straddling the bell crank lever 86 and the projections 160, 162 extend downwardly from the bight 168 of the configuration. The pivot pin 126 by which the levers 86 and 124 are interconnected also extends through the legs 166 near their lower extremities.

At its upper end, the lever 124 mounts two upwardly extending fingers 170 and each finger 170 is provided with a generally horizontally directed post 172.

Each post 172 is adapted to impale a movable metallic contact assembly 174 (only one of which is shown) via a central aperture 176 therein. Each contact assembly 174 carries two contacts 178 (only one of which is shown ) on opposite sides of the corresponding projection 170. The contacts 178 are staked as at 182 to the metallic contact assembly 174.

As a result of this construction, the contact assemblies 174 are free to float somewhat on the projections 172 to compensate for tolerance deviation.

When assembled, an end 182 of each spring 138 and opposite the end 136 thereof is fitted about the corresponding post 172 to engage the corresponding contact assembly 174 and urge the same against the corresponding finger 170. This urging, of course, maintains the contact assemblies 174 in place on their respective posts 172 and in addition, biases the third lever 124 in a counterclockwise direction about the pivot 126. This in turn means that the movable contacts 178 will be biased toward the fixed contacts 122.

The end 184 of the spring 150 opposite the end 148 is received in a depression 186 formed in a wall of the internal cavity of the module base 90 and is compressed thereagainst. As a result, the spring 150 will apply a clockwise bias to the bell crank 86 about the pivot pin 126 and such bias will in turn operate to bias the surface 144 into engagement with the surface 88 on the first lever 50.

FIG. 7 illustrates two extreme positions of movement of the bell crank 86 relative to the third lever 124. One position is shown in solid lines while the other position is shown in dotted lines. At a location of the bell crank 86 between such positions, the end 154 of the spring 156 will be closer to the end 158 than at either extreme position, which is to say the spring 156 is thus compressed. Such compression defines an over-center mechanism and provides snap action to the switch. That is, if the bell crank 86 is in its solid line position as viewed in FIG. 7 and a counterclockwise force is applied to the surface 144, initial movement will cause the spring 156 to be compressed. As the bell crank 86 moves past the point whereat the spring 156 is in maximum compression, the biasing force provided thereby will cause the bell crank 86 to snap rapidly toward the dotted line position to quickly bring the contacts 178 into electrical contact with the contacts 122 without any chattering.

When the counterclockwise biasing force against the surface 144 is sufficiently released, the spring 150 will be acting against the arm 142 when it has been positioned toward the dotted line position and will cause the same to move in clockwise direction relative to the arm 124. As soon as the over-center position is reached, the bell crank 86 will snap in a clockwise direction to rapidly break the electrical contact, again without chattering.

The construction is completed by a differential adjustment best seen in FIG. 6. In particular, the cap 92 is provided with a semicylindrical barrel 190 having an interior bore 192 terminating in a reduced diameter opening 194. A plunger 196 is captured within the bore 90 by an enlarged head 198 but extends through the opening 194 to be aligned with and in engagement with the arm 140 of the bell crank 86. A spring 200 is contained within the bore 192 and is in engagement with the head 198. A bolt 202 threaded into the bore 192 oppositely of the opening 194 is operative to adjust the bias that the spring 200 applies to the plunger 196.

Those skilled in the art will appreciate that by appropriately selecting the bias applied to the plunger 196, the differential of the switch may be selectively chosen.

In use, the switch may be installed with a fluid conduit threaded into the threaded bore 40 of the fitting 38 so that pressure in the fluid circuit will be applied to the side of the diaphragm 32 opposite the arm 50. The ends of one or more electrical conduits may be disposed in the apertures 28 in the legs 20 of the base 10 so as to lead electrical conductors contained within the conduits into the area between the legs 20 for connection to the switch module 12 by means of the terminal screws 112 or the spade terminals 114, or both. Suitable clamping elements (not shown) of conventional construction will be utilized to fasten the ends of such conduits in the openings 28. The cover 68 may then be installed in the manner mentioned previously.

Upon energization of the circuit, the switch assembly will then be operable to control operation of the circuit in response to the pressure applied against the diaphragm 32. Switch differential may be controlled by a appropriate adjustment of the bolt 202 and operating pressure selected by adjustment of the bias provided by the spring 62 through adjustment of the nut 64.

At such time as the contacts 122, 178 become sufficiently worn that the circuit cannot function reliably, all one need do is remove the cover 68 and the threaded fasteners 24. In addition, the electrical conductors entering the switch through the opening 28 are disconnected from the terminals 112, 114. However, the fluid conduit need not be disconnected from the fitting 38 nor is it necessary to break the connection of the conduit or conduits from the apertures 28. The module 12 may be removed simply by exerting force in a direction of an arrow 204 as viewed in FIG. 2. A new module 12 with contacts 122 and 178 in good condition may then be replaced in lieu of the one just removed by reversing the procedure. As a consequence, servicing is highly simplified and the possibility of leakage of a fluid being monitored avoided entirely.

I claim:

1. A fluid operated switch comprising:

a generally U-shaped base having a bight including an actuating aperture and spaced legs extending from the bight, at least one of said legs including an electrical conduit mounting aperture;

a diaphragm mounted on said bight over said actuating aperture remote from said legs;

a diaphragm housing secured and sealed against said bight to contain said diaphragm and having a fluid conduit receiving fitting on the side of said diaphragm remote from said bight;

a switch contact module including readily disconnectable electrical terminals adapted to be connected into an electrical circuit and relatively movable switch contacts for opening or closing such an electrical circuit and disposed between said legs;

nonsecuring mating means on said legs and on said module for orienting said module in a desired position relative to said base;

removable fastening means extending between said module and said base for removably securing said module in said desired position on said base; and motion transmitting means carried by at least one of said base and said module and including an actuator extending through said actuating aperture into nonconnected but abutting contact with said diaphragm and an operator movable in response to movement of said actuator for opening and closing said relatively m contacts;

whereby when said switch is installed with the fluid conduit receiving fitting connected to a fluid conduit and with an electrical conduit housing electrical conductors extending to said terminals secured to said electrical conduit mounting aperture, replacement of said module and the contacts therein may be readily effected by disconnecting the conductors from the terminals and removing said fastening means and without disconnecting fluid and electrical conduits from said base.

2. The switch of claim 1 wherein said motion transmitting means comprises a lever pivoted to said base.

3. The switch of claim 1 wherein said motion transmitting means comprises a lever pivoted to said module.

4. The switch of claim 1 wherein said motion transmitting means comprises nonconnected but interengaging levers, one pivoted on said base and another pivoted on said module.

5. The switch of claim 4 further including a compressible spring extending between said module and said another lever so as to be compressed thereby, said another lever being movable on said module between open contact and closed contact positions, said spring being so located as to be under maximum compression when said another lever is between said position to thereby provide snap action movement of said lever.

6. The switch of claim 1 wherein said mating means comprise open ended slots in one of said module and said legs and projections slideably received in said slots and carried by the other of said module and said legs.

7. The switch of claim 6 wherein said slots are in said legs and said projections are carried by said module.

8. A fluid operated switch comprising:

a base including an actuating aperture and at least one electrical conduit mounting aperture;

a diaphragm mounted on said base over said actuating aperture;

a diaphragm housing secured and sealed against said base to contain said diaphragm and having a fluid conduit receiving fitting on the side of said diaphragm remote from said base;

a switch contact module including readily disconnectable electrical terminals adapted to be connected into an electrical circuit and relatively movable switch contacts for opening or closing such an electrical circuit;

removable fastening means extending between said module and said base for removably securing said module in a desired position on said base; and motion transmitting means carried by at least one of said base and said module and including an actuator extending through said actuating aperture into nonconnected but abutting contact with said diaphragm and an operator movable in response to movement of said actuator for opening and closing said relatively movable contacts;

whereby when said switch is installed with a fluid conduit receiving fitting connected to a fluid conduit and with an electrical conduit housing electrical conductors extending to said terminals secured to said electrical conduit mounting aperture, replacement of said module and the contacts therein may be readily effected by disconnecting the conductors from the terminals and removing said fastening means and without disconnecting fluid and electrical conduits from said base.

9. The switch of claim 8 wherein said motion transmitting means includes a first lever pivotally mounted on said base and having said actuator; and said module includes a second lever in abutting but noncontacting relation to said first lever, a third lever pivoted to said second lever and carrying at least one movable contact, and a module base pivotally mounting said second and third levers and carrying fixed contacts and said terminals, and resilient compressible means interconnecting said second and third levers and disposed to be under maximum compression when said second and third two levers are in between two extreme positions of relative movement with respect to one another to thereby provide an over-center, snap action connection between said second and third levers.

10. The switch of claim 8 wherein said motion transmitting means includes a first lever pivotally mounted on said base and having said actuator; and said module includes a second lever in abutting but noncontacting relation to said first lever, a third lever pivoted to said second lever and carrying at least one movable contact, and a module base pivotally mounting said second and third levers and carrying fixed contacts and said terminals, a first spring interconnecting said second lever and said module base for urging said second lever toward said first lever and a second spring interconnecting said third lever and said module base for urging said third lever toward said fixed contacts.

11. The switch of claim 10 wherein said at least one movable contact is loosely impaled on a post carried by said third lever and said second spring further acts against said at least one movable contact oppositely of said third lever to maintain said at least one movable contact on said post.

12. The switch of claim 9 wherein said module base reciprocally mounts a plunger in alignment and engageable with said first lever; spring means carried by said module for biasing said plunger toward said first lever; means carried by said module for adjusting the bias of said spring means; and further adjustable biasing means carried by said base for biasing said first lever toward said diaphragm.

* * * * *